US008567869B2

(12) United States Patent
Kussel et al.

(10) Patent No.: US 8,567,869 B2
(45) Date of Patent: Oct. 29, 2013

(54) SHIELD CONTROL DEVICE FOR CARRYING OUT THE LONGWALL FUNCTION OF A LONGWALL UNIT IN THE LONGWALL FACE WORKING IN A MINE

(76) Inventors: Willi Kussel, Werne (DE); Peter Rahms, Billerbeck (DE)

( * ) Notice: Subject to any disclaimer, the term of this patent is extended or adjusted under 35 U.S.C. 154(b) by 840 days.

(21) Appl. No.: 12/664,597

(22) PCT Filed: May 9, 2008

(86) PCT No.: PCT/DE2008/000793

§ 371 (c)(1),
(2), (4) Date: Dec. 14, 2009

(87) PCT Pub. No.: WO2008/138316

PCT Pub. Date: Nov. 20, 2008

(65) Prior Publication Data

US 2010/0276981 A1 Nov. 4, 2010

(30) Foreign Application Priority Data

May 12, 2007 (DE) ..... 10 2007 022 601

(51) Int. Cl.
*E21D 23/14* (2006.01)

(52) U.S. Cl.
USPC ..... 299/1.7; 405/302

(58) Field of Classification Search
USPC ..... 299/1.05, 1.3, 1.6, 1.7; 405/302
See application file for complete search history.

(56) References Cited

U.S. PATENT DOCUMENTS

| | | | | |
|---|---|---|---|---|
| 4,518,285 | A * | 5/1985 | Weber et al. | 405/302 |
| 4,693,640 | A | 9/1987 | Berger | |
| 5,029,943 | A * | 7/1991 | Merriman | 299/1.7 |
| 2004/0075121 | A1 | 4/2004 | Yu et al. | |
| 2009/0168606 | A1 * | 7/2009 | Lerche et al. | 367/197 |

FOREIGN PATENT DOCUMENTS

| | | |
|---|---|---|
| DE | 32 17 616 | 11/1983 |
| DE | 37 42 184 | 6/1989 |
| DE | 39 23 593 | 2/1990 |
| DE | 195 46 427 | 8/1996 |
| DE | 102 07 698 | 10/2002 |

OTHER PUBLICATIONS

Internationl Search Report for International Application No. PCT/DE2008/000793.

* cited by examiner

*Primary Examiner* — Sunil Singh
(74) *Attorney, Agent, or Firm* — Alston & Bird LLP

(57) ABSTRACT

The shield control device of a longwall shield for carrying out the longwall functions of the longwall shield in the longwall face working in a mine is associated with a distributing device upstream of a group of functional elements. Each of the functional elements of the longwall shield is associated with an exclusive address code word, on the call of which the internal connection between the shield control device and the functional elements depends. The distributing device is arranged in close proximity to the functional elements. The functional elements are valves or sensors.

15 Claims, 6 Drawing Sheets

SHIELD CONTROL DEVICE FOR CARRYING OUT THE LONGWALL FUNCTION OF A LONGWALL UNIT IN THE LONGWALL FACE WORKING IN A MINE

BACKGROUND OF THE INVENTION

1. Field of the Invention

The invention concerns a shield control device of a longwall shield for carrying out the longwall functions of the longwall shield (longwall unit) in the longwall face working in a mine.

2. Description of Related Art

A control device is known, for example, from DE 103 93 865.6 A1. In the case of this longwall control the individual longwall units, described in this application also as shield or longwall shield, can be controlled from a central control device or by the individual control units that are assigned to each shield (shield control devices) or by an operating device via radio for data transfer. For this purpose each shield control device has a microprocessor with memory to store the code signal (shield codeword) assigned to the shield control device. The data transfer of the external control devices (they are first of all the shield control devices of the other longwall shields of the longwall as well as the central control device) to the function elements of the shield control device via their internal connecting means is effected or carried out only when the shield control device is triggered by the shield codeword assigned to it.

The data transfer within the shield comprises the electrical communication between the shield control device and the function elements (operating magnets and sensors) of the respective longwall shield, in particular therefore first of all the issuing of operational commands to the power source of the longwall shield; these are in particular the operating magnets of the respective hydraulic valves to actuate the power source/actuators as well as in the second place the call/request and the transmission of the measuring signals of those sensors which are assigned to each longwall shield, e.g. to measure the pressure of the power source or measure the inclination or position of the components of the longwall shield. Adjacent or several neighbouring shields can be also triggered from each shield control device to issue commands or to retrieve measuring signals. Basically all signals, i.e. issue of commands (command signals), request of measuring signals (call signals) as well as the measuring signals themselves, in this application: control signals via a common line (busbar) common for all shield control devices, are conveyed to all shield control devices. However, the shield control devices are so programmed, that only that shield control device is addressed and prompted to carry out the control signals, to which the shield codeword issued with the control signal is assigned. All other shield control devices pass on the control signal with the shield codeword.

SUMMARY OF VARIOUS EMBODIMENTS

This invention deals with the problems of data transfer of the shield control device within each longwall shield. Hitherto for data transfer the shield control device has to contain connecting means, therefore electric lines and multi-core cables to a plurality of function elements, while these function elements are partly combined into groups, e.g. the operating magnets of hydraulic valves are combined in blocks while on the other hand they are partly identical or at least similar. The laying of these electrical lines and cables within the longwall shield is not only difficult, expensive and susceptible to errors, it may also run the risk of becoming damaged during operation.

The object of the invention is to construct a shield control device that reduces the expenses of cabling and is limited to the absolutely necessary cables.

The solution becomes obvious from various embodiments of the present invention.

This construction has the advantage that within the shield control device of each longwall shield the electrical data transfer to carry out the longwall functions, i.e. the electrical data transfer to retrieve the test signals of the sensors, the electrical data transfer to transfer the test signals as well as the electrical data transfer to transfer operational commands to the actuators, can be established via the internal connecting means within the longwall shield with little outlay on cabling. For this reason the shield control and the cabling of the shield can be pre-manufactured to a great extent, so that line errors due to faulty cabling or later damages can be significantly prevented.

With this solution to each function element of the longwall shield each time one code signal (address codeword) is assigned that is valid only for this function element. This allows the function of calling (activation) of a certain function element, hitherto centrally performed in the shield control device, to be carried out decentralised on the spot. For this purpose a distributor is used, that is connected into the internal connecting means of the shield between the shield control device and the function elements and is spatially as close as possible to the function element. As in the execution according to one embodiment, this distributor can be connected with the shield control device via only one cable with a few wires. It comprises a microprocessor with a memory as well as switching equipment with individual switching elements, via which the internal connecting means produces and interrupts the connection to the function element to be called and to be activated. When now a so called call codeword for a certain function element of the shield is sent to the microprocessor of the distributor from the shield control device via the said cable, it will be compared in the microprocessor with the address codewords stored in its memory. If the call codeword and the address codeword stored in the memory coincide, the switching equipment is activated via the microprocessor in that sense, that the connection for signal transfer between the shield control device and that function element whose address codeword is identical with the call codeword, will be established.

In the configuration according to another embodiment the connecting means for data transfer between the distributor and the function elements is established via a cable each for each of the function elements. At the same time only one distributor with one microprocessor and switching equipment is required. Via the switching elements of the switching equipment the connection to each of the function elements connected can be established independently as to which call codeword had been sent previously to the distributor via the shield control device. The leads can be essentially arranged within the distributor and by virtue of this be protected from faulty laying and damages.

This configuration is particularly suitable when the function elements are the operating magnets of the hydraulic valves of the longwall shield and the data transfer is used to transfer operational commands to the operating magnets with the preferred further development according to another embodiment.

In the case of the configuration of the invention according to another embodiment, the distributor is spatially in or in the vicinity of each function element. In the case of this configuration one cable to transfer data between the shield control device and the first of the function elements is sufficient. The function elements can be connected with one another by a common busbar that transfers the control signal to all function elements while, however, in or on each function element a microprocessor with a switching equipment is provided that transfers the transferred control signal to the called function element and activates it in the manner of the control signal.

This configuration or the one to be described in the following is particularly suitable for the case when the function elements are the sensors of the hydraulic valves of the longwall shield and the data transfer is used for transmitting the measuring signals of the sensors to the shield control device and to the external control devices with the preferred further development according to another embodiment.

When the function elements are the operating magnets of the hydraulic valves of the longwall shield and the data transfer is used for transmitting operational commands to the operating magnets in the further configuration according to another embodiment the hydraulic valves are combined in one or several valve blocks. The advantage of this is that the operating magnets will be also positioned close to one another preferably tightly next to one another and the distributor can be located spatially close to the valve block. For the connection with the shield control device one command cable with at least two wires is sufficient to transmit operational commands.

The distributor in this case also comprises the microprocessor with memory for the address codes as well as switching equipment, via which, in accordance with the incoming operational command, that operating magnet whose address code corresponds with the called call code, is triggered with the electric energy required for its movement via internal cable connections. For this purpose the distributor and the switching equipment are connected with a single electric line of, for example, 12V.

At the same time by virtue of an appropriate construction of the valve blocks the operating magnets can be also arranged in blocks, so that their operating connections are preferably provided in one plane or on a straight line. Due to this the distributor can be also executed as a flat body, the operating connections of which are constructed as plug and socket connections or sliding contacts, that spatially, and naturally, also electrically correspond with the plug and socket connections or sliding contacts of the operating magnets. In this manner in the execution according to another embodiment the operating cable between the distributor and the function elements is avoided with all its disadvantages. The connection from the distributor to the individual operating magnets and their charging with energy is carried out via a) a short cable, in contrast to the hitherto long cables that were necessary between each operating magnet and the shield control device, b) direct plug-in connectors, which are possible since and when all operating magnets of a block are provided in a flat field, e.g. a batten-shaped field and in one plane.

At the same time, however, there is the disadvantage, that 12, for example, plugs are never accurately aligned with their counterparts. Therefore the single counterpart of the connector has to have a certain mobility parallel to that plane in which the connectors fastened on the distributor are fastened. Sliding contacts (battery contacts) are more convenient, wherein the contact elements are provided in one plane (contact plane) and the counterpart has mating contacts congruently arranged, which lie against the contact elements by sliding them parallel with the contact plane or placing them perpendicularly to the contact plane.

When the function elements are the sensors of the hydraulic valves of the longwall shield and the data transfer is used for the transmission of measuring signals of the sensors to the shield control device and to the external control devices, the sensors are joined with one another in series via a measuring cable (busbar) and with the shield control device via a single signal cable. In this case each sensor has a microprocessor that makes the measuring signal continuously available for interrogation and comprises the switching equipment to retransmitting the waiting measuring signal. When the microprocessor of the first sensor, directly connected with the shield control device, establishes by comparison that the call codeword transmitted by the shield control device corresponds to the address codeword of this sensor stored in the memory of this sensor, the signal cable will be connected with the measuring line by means of the switching equipment of this sensor, so that the measuring signal is transferred to the shield control device. The busbar to the next sensor will be interrupted.

When the call codeword of the first sensor, directly connected with the shield control device and transmitted by the shield control device does not correspond with its address codeword, the busbar will be connected by means of the switching equipment of this sensor to the next sensor and the switching equipment remains in this closed position. Afterwards the interrogation and comparison process is carried out in this next sensor, resulting in that the busbar will be perhaps connected with the measuring line of this sensor, so that the measuring signal of this sensor is transmitted to the shield control device and the busbar to the next sensor will be interrupted.

The same process could also take place as follows: the switching equipment of all sensors are provided in the common busbar and in the non-loaded position keep the connection between the sensors permanently closed. Therefore a call codeword transmitted by the shield control device reaches all sensors or the microprocessors contained in them. The microprocessor of that sensor, whose address codeword, stored in its memory, corresponds with the call codeword transmitted, actuates the switching equipment and connects the measuring line of this sensor with the data cable, so that the measuring signal will be transmitted to the shield control device. The busbar to the next sensor will be interrupted.

The measuring signal of the sensors is always present. For this purpose the sensor may be fitted with a measured value memory, from which during transmission of the call code the measured value can be retrieved by operating the switching equipment. However, the measuring signal can be also continuously measured by the sensor and the actual measured value can be retrieved from the sensor when transmitting the retrieval code by actuating the switching equipment.

Control devices, and among them shield control devices, for a number of function elements, that make the data traffic with one of the function elements dependent on the address codeword coinciding with a call codeword, have the advantage that the function elements can be of any design and do not have to be harmonised with the control device. This, however, has the disadvantage that function elements with unreliable function could be used.

A further task of the invention is for the shield control devices according to the preceding claims as well as other control devices of this type. In the case of control devices of this type it has to be ensured that only correctly constructed function elements and thus secure ones are used. This is particularly important for the underground safety in mines.

This further development becomes obvious from another embodiment.

In this conjunction the connecting means to transmit signals between the control device and the function element and the microprocessor, whose address codeword is identical with the code signal (call codeword) that could be transmitted by the control device, can be activated only when in addition to and together with the call codeword a code signal (type codeword), characteristic for the type of the function element and stored in the memory of the microprocessor of each function element according to its type, is transmitted.

Another embodiment shows in a further development as to how the call codeword, address codeword and type codeword are combined with one another.

BRIEF DESCRIPTION OF THE SEVERAL VIEWS OF THE DRAWINGS

In the following an embodiment of the invention is described based on the drawing.

They show in.

DETAILED DESCRIPTION

Figure 1:
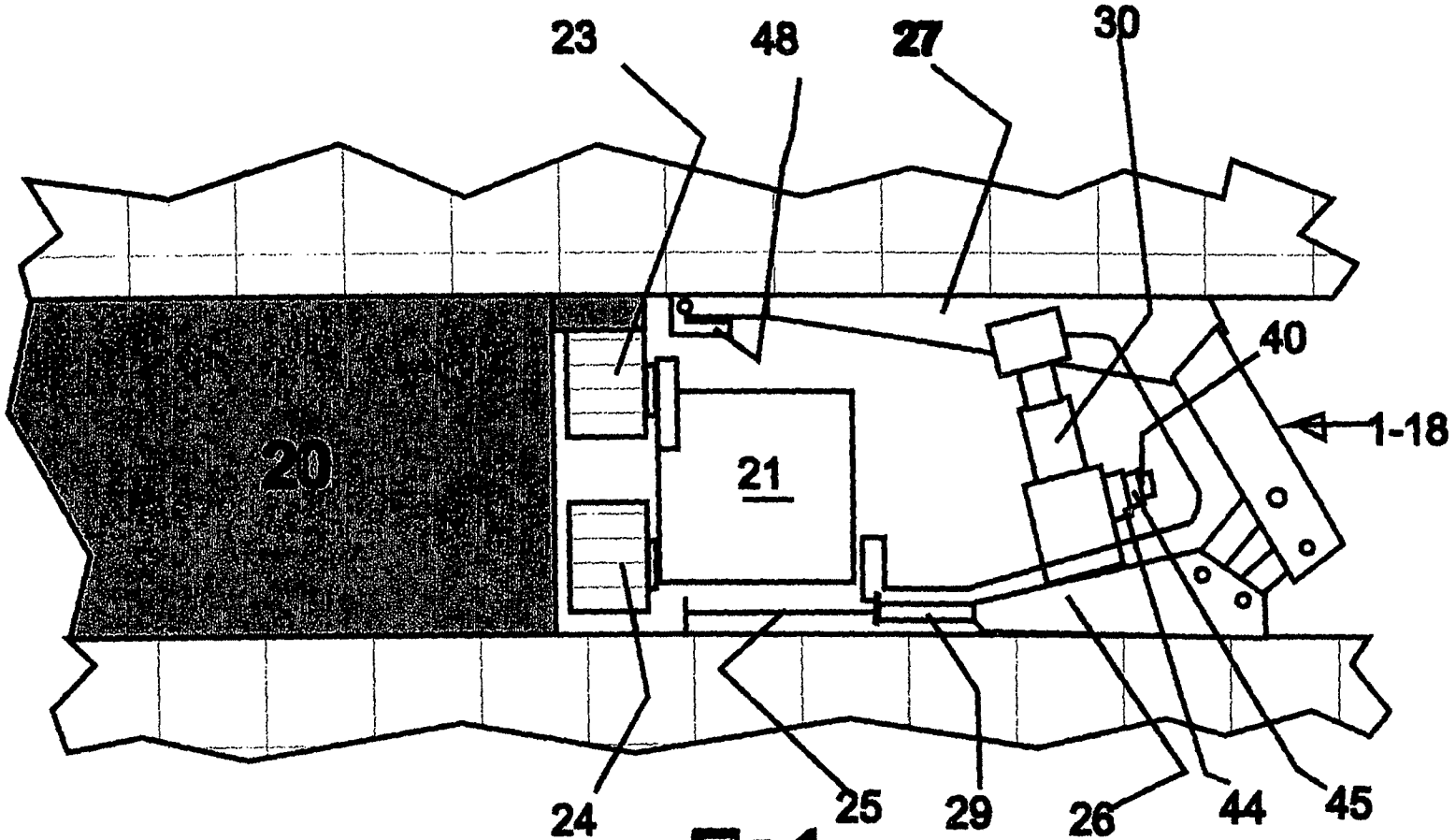
FIG. 1—the section through a longwall face with a longwall shield.
Figure 2:
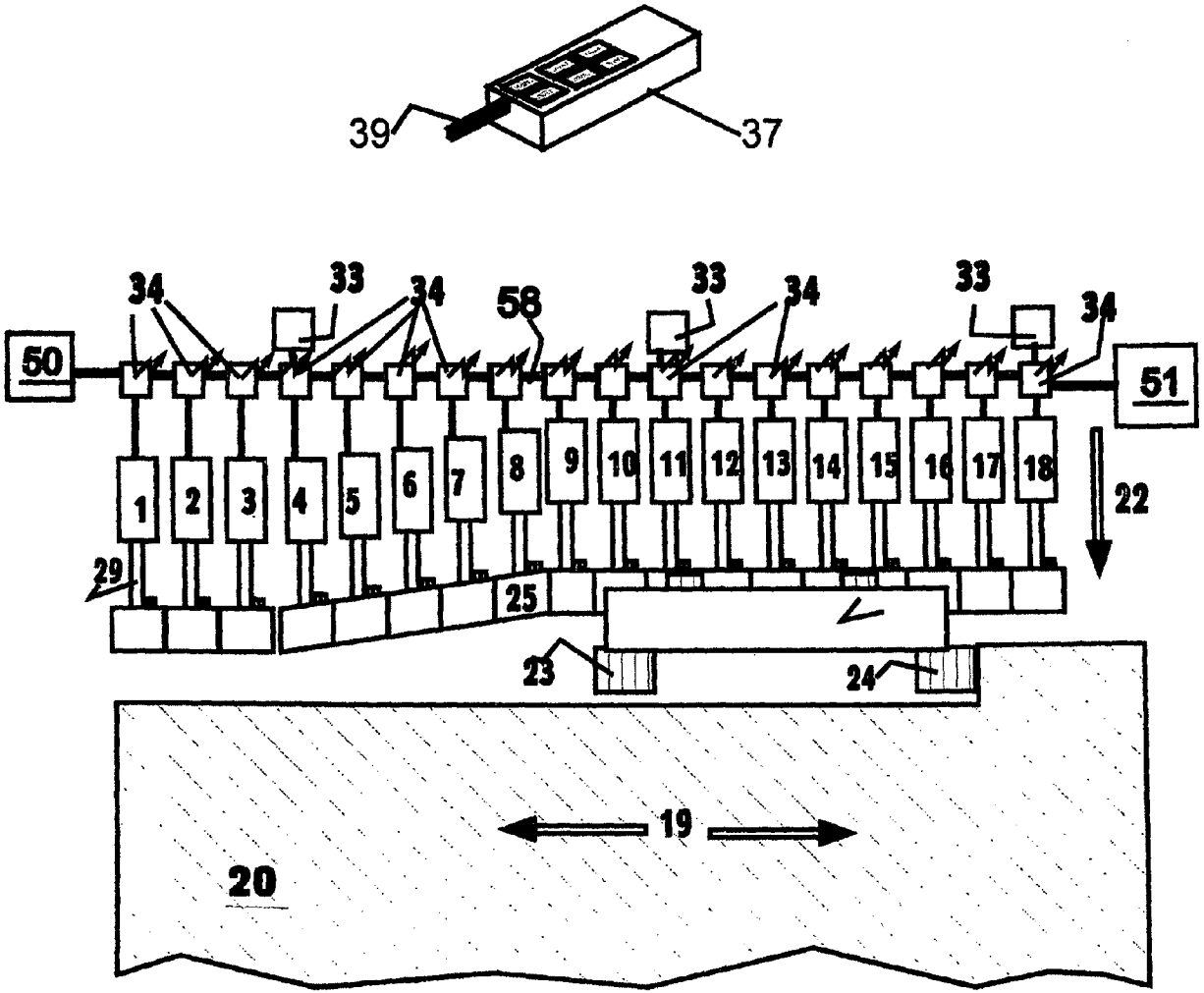
FIG. 2—the schematic view from above on a ripping machine and a group of longwall shields, FIG. 3—the schematic illustration of a shield control device with sensors and operating magnets, FIG. 4—an enlarged detail of FIG. 3 with the triggering of the operating magnets, FIG. 5—an enlarged detail of FIG. 3 with the triggering of the sensors, FIG. 6—enlargement of a suitable sliding contact connection to connect the distributor with the operating magnets.

In FIG. 1 one of the longwall units 1-18 is shown, generally described, as in this application, as longwall shield or shield. In FIG. 2 a plurality of longwall units 1 to 18 are shown. The longwall units are arranged along a seam 20. The seam 20 is mined with a shearing machine 23, 24 of a mining machine 21 in the direction 22 of mining. In the embodiment the mining machine is in the form of a ripping machine 21.

The ripping machine 21 can be displaced by means of a ripping drag cable (not illustrated) in the direction 19 of cutting. It has two shearing rollers 23, 24 that are set to different heights and cut the coal face. The broken coal is loaded from the ripping machine, also called "roller loader", on a conveyor. The conveyor comprises a chute 25, in which an armoured conveyor is moved along the coal face. The ripping machine 21 can be displaced along the coal face. The chute 25 is divided into individual units, which, though joined with one another, can move relative one another in the direction 22 of mining. Each unit is joined by means of a cylinder/piston unit (inching piston) 29 as power source with one of the longwall units 1-18. The purpose of every longwall units is to support the longwall face. For this purpose further cylinder/piston units, e.g. 30, are used, that brace a bottom plate against a roof plate. At its front end, facing the seam, the roof plate has a so called coal bumper 48. In this case one deals with a flap that can be hinged in front of the mined coal face. The coal bumper has to be swivelled up in front of the moving ripping machine 21. A further cylinder/piston unit (not illustrated) is used for this purpose also. These function elements of the individual longwalls are illustrated here only in the form of an example. There are further function elements present: in this case one deals with a further power source on the one hand, in particular with hydraulic cylinder/piston units, but also with sensors 46 (FIGS. 3, 5) (not illustrated), by means of which the pressure of the hydraulic power source, for example, or the path traveled or the position of the shielded movable and displaceable parts of the shield are measured and monitored.

These cylinder/piston units are actuated via valves 44 and servo valves 45. On each valve/servo valve a housing with valve control in its interior as well as an operating magnet 47 for the displacement of the servo piston or main control piston is mounted.

In FIG. 2 the ripping machine moves to the right. Therefore the coal bumper of the longwall unit 17 has to be swivelled back. On the other hand the unit of the chute 25 (shot) on the longwall unit 9, that in the direction 19 of travel is behind the ripping machine 21, is moved forward in the direction of the mined coal face. The following longwall units 8, 7, 6, 5 and 4 are likewise moving forward in the direction of the longwall face and the mined coal face. On these longwall units the coal bumper is already swivelled downwards. The longwall units 3, 2, 1 are moved back and remain in this position until the ripping machine comes closer from the right.

The control of these movements takes place partly automatically in accordance with a stored program depending on the movements and the temporary position of the ripping machine, partly manually. For this purpose a shield control device 34 is assigned to each longwall unit 1-18. Each shield control device 34 is connected with the function elements of its longwall shield, in fact particularly with the sensors 46 and the operating magnets 47 of the servo valves 45 and the main valves 44 of the power source. Details of this will be described later based on FIGS. 3, 4 and 5.

To enter data, in particular commands or to interrogate data, any of the shield control devices can be used. However, to a group of several shield control devices one longwall face control 33 or to the entire lot of shield control devices a manual operating device 37 or a central longwall control (main control centre 50 and/or auxiliary control centre 51) for the data input can be superimposed, that is connected with the shield control devices. Such a configuration is shown in FIG. 2.

The central longwall control comprises the main control centre 50 and the auxiliary control centre 51. In the main control centre 50 and/or the auxiliary centre 51 the program for the automatic operation of the longwall control and automatic input of the longwall commands (clearing, advancing, erecting the longwall shields) depending on the position of the longwall machine, is stored. Consequently the measured values (sensor signals) of the individual sensors can be called up programmed from the main control centre 50 and/or the auxiliary control centre 51. The issue of commands call of the sensor signals and the retrieval of the sensor signals can be carried out from the main control centre 50 and/or the auxiliary control centre 51 or manually from the manual operating. The cable 58 (busbar) connects all shield control devices 34 with one another. The entered or transmitted longwall commands, status reports and other data are received by and transmitted to all other shield control device via each shield control device.

However, by means of a predetermined encoding (shield codeword) only one of the shield control devices 1-18 or one group of shield control devices is activated to carry out the requested function, e.g. interrogation of the measured value or of the longwall function, for example in the sense of clearing, advancement, setting. Thus the activated shield control device converts the received function command, e.g. interrogation of measured values or longwall command, into a command to the function elements, sensors, servo valves or main valves assigned to the relevant longwall shield.

The triggering of the shield control device of a specific longwall shield and the automatic launching of the functions and function processes is described, for example, in DE A1 195 46 427.3.

The manual device 37 has wireless connection with the radio receivers 38, said radio receivers being provided in each of the shield control devices. The shield control device, that is closest to the operating device, receives the strongest signal. Accordingly, this shield control device retransmits the received signal via the busbar 58, so that the shield control device addressed by the entered shield codeword can react correspondingly. The aerial 39 of the manual device is used for the wireless transmission.

In the shield control device or in the main control centre 50 or in the auxiliary control centre 51 a program can be stored, with which interrogations of the individual sensors or sequences of such interrogations regarding functions, operational status and functional progress in each shield (longwall) can be carried out. The data obtained is then simultaneously transmitted via cable 58 to the neighbouring shield control devices and from one of the shield control devices via wireless to the manual device and/or main control centre 50 or the auxiliary control centre 51 and illustrated on a display. This way the operator can be satisfied whether a certain shield is still fully functional or whether maintenance or replacement of the function elements or of the control elements is necessary.

Figure 3:
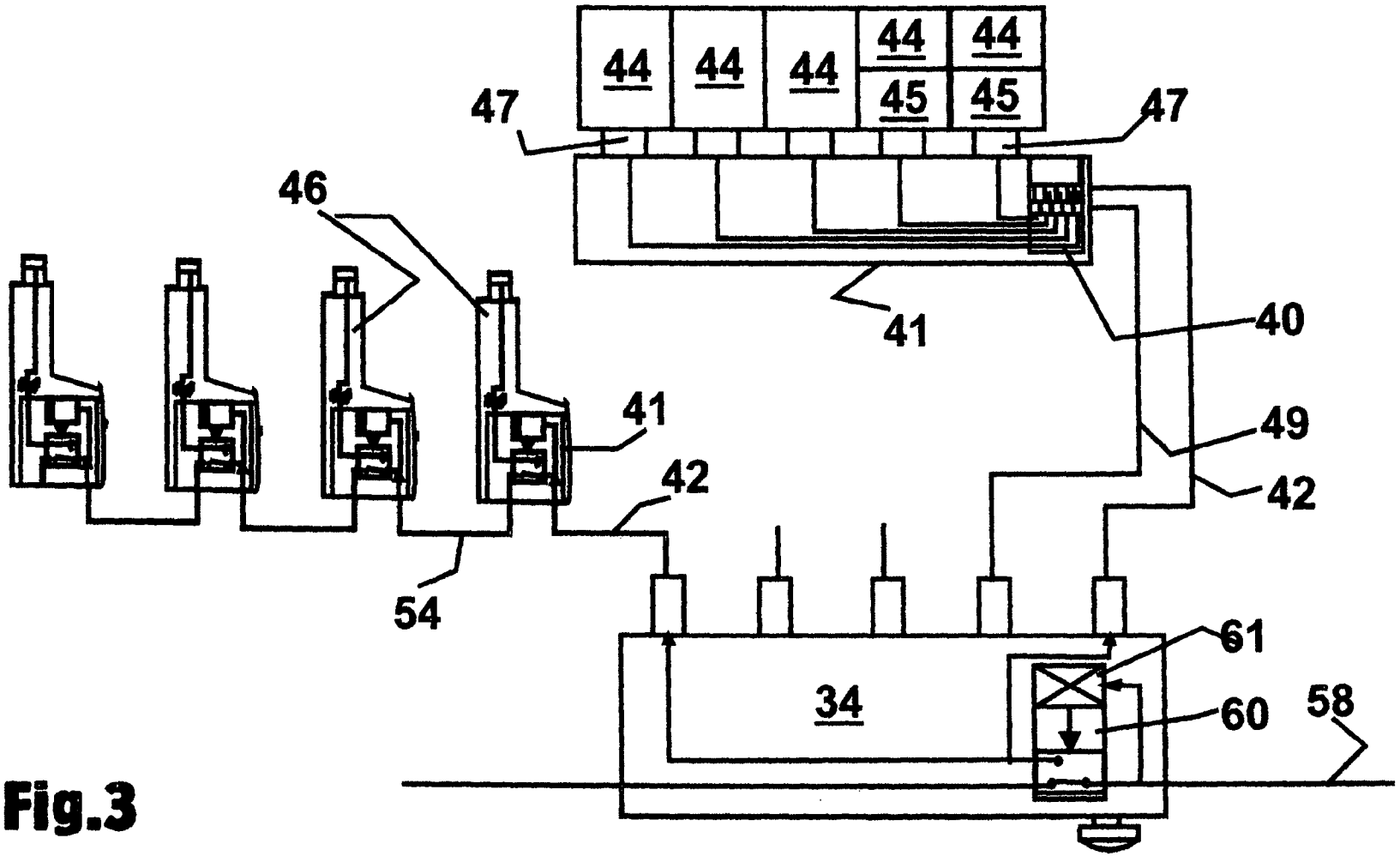
Figure 4:
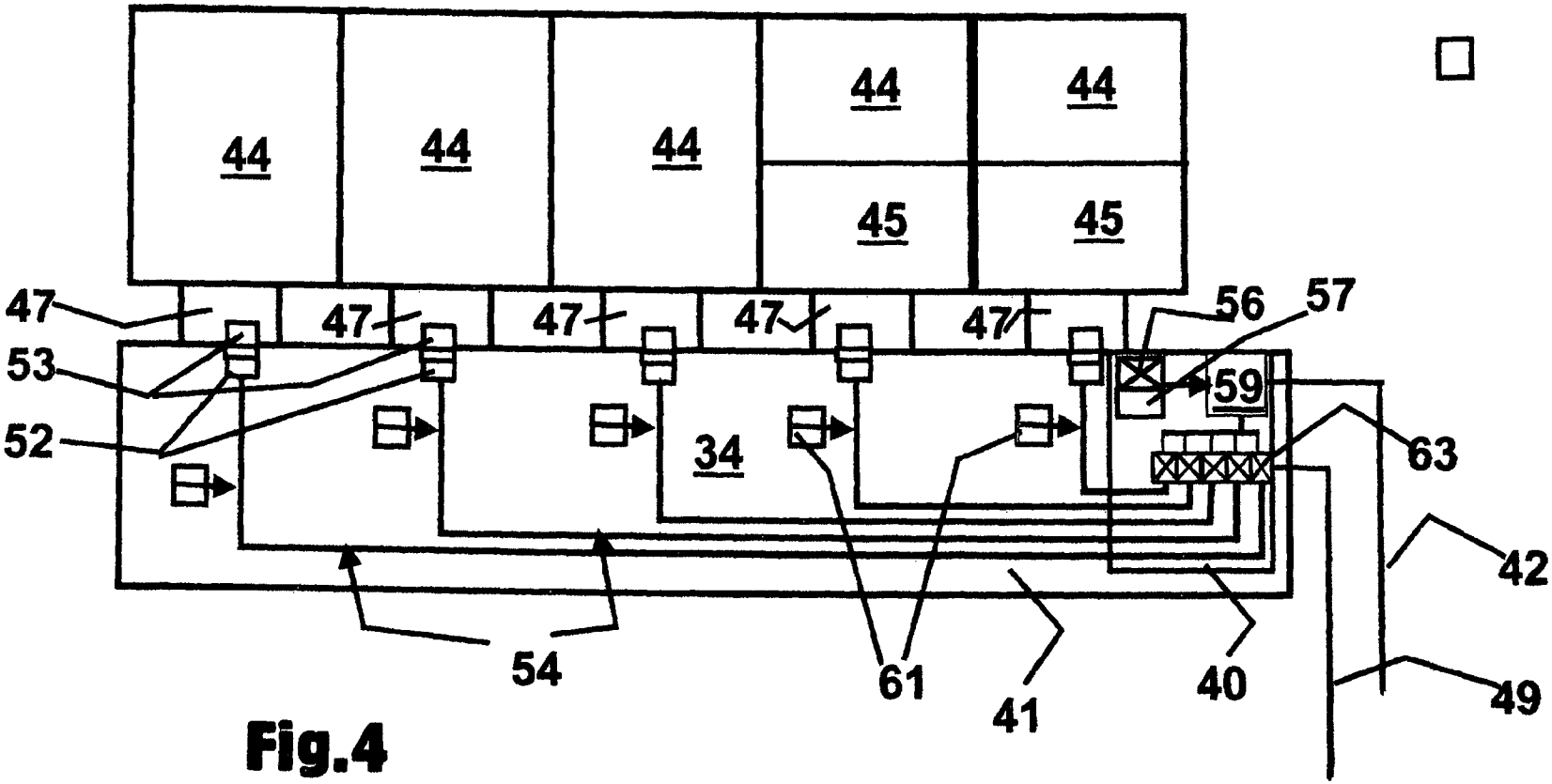
Figure 5:
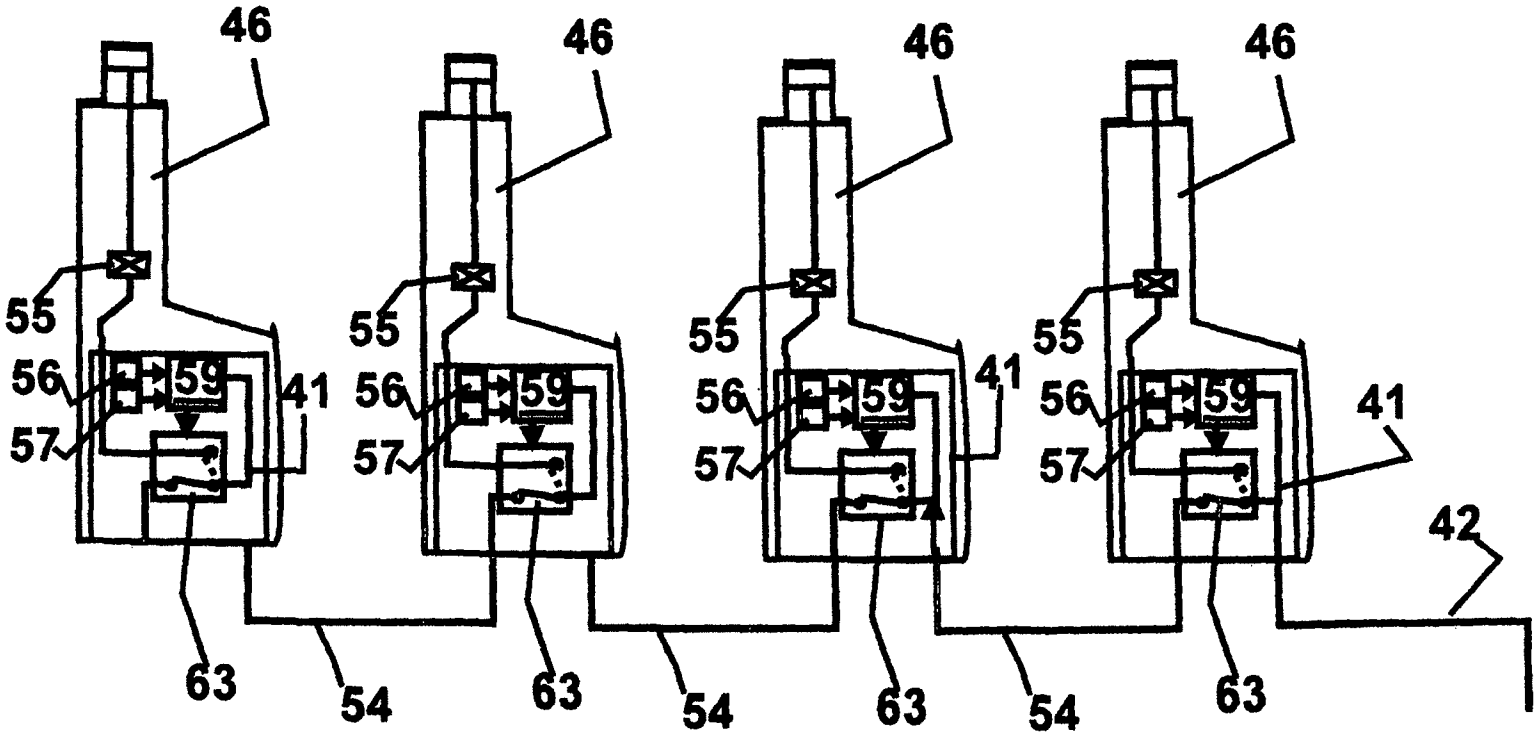

The principle of connection and switching circuits of the individual shield control device 34 with the function elements of its longwall shield, i.e. particularly with the operating magnets 47 for entering commands and with the sensors 46 for interrogating measured values is illustrated in FIG. 3 with the details shown in FIGS. 4 and 5. These switching circuits are present in every longwall shield.

A shield control device 34 of a plurality of shield control devices is shown. The shield control device is connected with the other shield control devices and with the main control centre 50 and the auxiliary control centre 51 via a busbar 58. At the entry of the busbar 58 the shield control device has an input element, in particular a processor 60 with a normally closed switch 62, so that a passing through of the incoming signals from one shield control device to the next one will take place. However, the division of the busbar and further activation of the shield control device takes place when a signal with the shield codeword enters via the busbar, said codeword corresponding with the shield codeword assigned to the shield control device and stored in the memory 61 of the shield control. In this case the incoming signal is processed in the called up shield control device, for example to carry out operational commands in the sense of a longwall function or to retrieve or transmit measured values.

As it is illustrated in FIGS. 3 to 5, according to this invention distributors 41 are provided to distribute the data traffic within each shield control to the function elements, sensors and power sources or their operating magnets addressed or to be addressed. In this conjunction the distributor can be provided either in each of these function elements or provided upstream of a group of function elements. In any case within one longwall shield only one cable 42 is provided for the connection between the shield contact device 34 and one of the distributors 41 with a group of function elements. The distributor or the distributors are provided spatially tightly on the respective function elements. Therefore a multiple, elaborate and vulnerable cabling between the shield control device is avoided despite the large number of function elements involved in the data traffic.

For the valves 44 or servo valves 45 of the power source and their operating magnets in the execution according to FIGS. 3 and 4 a distributor 41 is provided, that is provided upstream of a group of operating magnets and is common for all operating magnets of the group of operating magnets. This execution has the advantage that no microprocessor for triggering are assigned to the operating magnets and the functionality of these microprocessors can be reduced to a minimum.

Furthermore, in the case of the embodiment according to FIGS. 3 and 4 there is no need at all for external cabling between the distributor and the assigned operating magnets.

For this purpose the valves 44 or servo valves 45 and the operating magnets 47 of the power source are aligned in one plane or in one straight line, but in any case so that they have electrical plug connectors 53 to be connected to the distributor which have parallel directions of insertion and are preferably situated in one plane or in a straight line.

Figure 6:
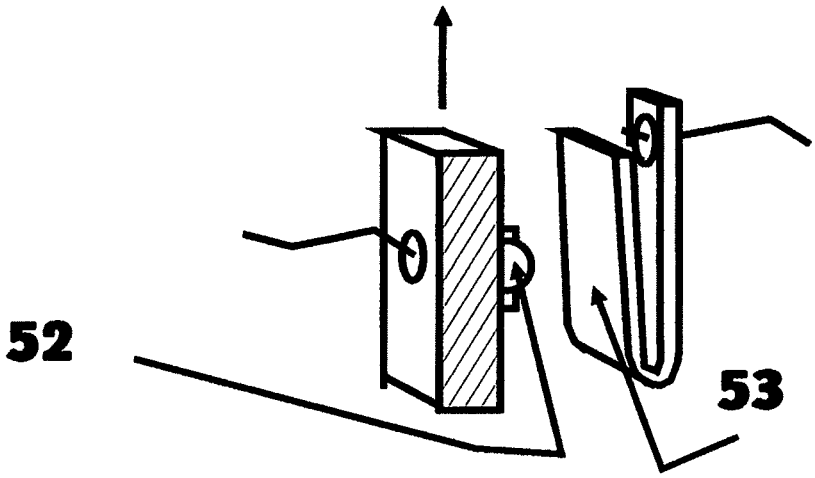

The distributor 41 is constructed as a flat, straight beam. On that side, that faces the operating magnets of the group of valves arranged in a steel block, it has the connector contacts 52 that geometrically correspond with the mating contacts 53 of the operating magnets. An additional guide may be provided, in which the distributor can be guided electrically and mechanically connected with the operating magnets and their connectors. The connectors of the operating magnets and/or the connectors of the distributor preferably have a small lateral mobility to compensate for the errors of geometrical arrangement and allocation. As plug connectors of this kind so called battery contacts are especially suitable, which on one side have contact prongs resiliently moving in the direction of insertion and on the other side a rigidly fastened contact body, contact pin or the like. In this case the lateral mobility in one direction is resulting from the width of the contact prongs and in the direction perpendicular to it from the elasticity of the contact prongs (e.g. FIG. 6).

The connector contacts 52 in the distributor 41 are joined by an internal cable connection 54 with the valve control unit 40 provided in the distributor 41. The valve control unit 40 is connected via the data cable 42 with the shield control device 34 and via that with the other shield control devices and the main control centre 50 and the auxiliary control centre 51. The valve control unit 40 has a microprocessor 59 with memory 56. In the memory an individual codeword (address codeword) is stored for each of the operating magnets connected. On the other hand, in the shield control device in a memory 57 an individual call code for the type of function element to be triggered is stored for every longwall function and every incoming command. Depending on the incoming signal and its actual content, by activating the shield control device the call code of the function element that has to carry out the requested function, is also sent via the data cable 42.

The microprocessor 59 triggers the switching elements 63, that establish the connection of the electrical line, e.g. 12V line 46 to the function elements/operating magnets, and activates a single switching element 63 connected to the operating magnet, the address code of which corresponds with the incoming call code. This operating magnet is then charged via one of the internal cable connections 54 with the voltage required for its displacement.

In the execution according to FIGS. 3 and 5 for the sensors 46 a distributor 41 is provided in each sensor.

The advantage of this execution is that microprocessors are assigned to the sensors, making the sensors autarchic, i.e. independent from the shield control device used at the time.

Furthermore, in the embodiment according to FIGS. 3 and 5 the cabling between the shield control device and the sensors is reduced to a single cable.

In each sensor 46 a distributor 41 is provided. It has a microprocessor 59 with memory 56. In the memory 56 a codeword (address codeword), individual for the sensor, is stored. On the other hand, as explained, in the memory 57 of the shield control device for each incoming command a call code is stored, that is individual for the function element/sensor to be triggered. Depending on the incoming signal and its actual content, by activating the shield control device the call code of the sensor 46, the measured value of which is to be interrogated, is transmitted via the data cable 42 first to the first of the sensors 46 and via the internal cable connection 54, comprising a single cable, to all other sensors connected in succession. The switch 63 of the distributor 41 is normally closed, so that a passing through to the other sensors takes place. However, the division of the busbar takes place when its address code corresponds with the incoming call code.

For this purpose the microprocessor 59 triggers the switching element 63 in the sense of connecting the called up sensor 46, the address code of which corresponds with the incoming call code. The measured value of the called sensor can be now transmitted to the shield control device or the main or auxiliary control centre or a manual input device.

On this occasion one can deal with the actual measured value. However, one can also deal with measured values yet to be covered, that is stored in a memory 55 of the sensor.

When the switching element 63 of the sensors is not permanently closed, first the address code of the first sensor 46 is compared with the incoming call code. Only when the address code does not correspond with the call code, will the incoming command passed on through the switching element 63 via the internal cable connection 54 to the next sensor and its distributor and so on, until the address code corresponds with the call code. Only then will a connection of the data line 42 through the switching element 63 take place to the respective sensor 46 and the internal cable connection 54 to the further sensors remains disconnected.

The advantage, already mentioned, that by virtue of the microprocessors assigned to the sensors the sensors are autarchic, i.e. independent from the shield control device used at the time, disadvantages regarding safety and reliability may also be present. For this reason it has already been pointed out, that it needs to be ensured that only correctly constructed and consequently safe function elements are used and that this is especially important for the underground safety in mining. This development is also obvious from FIG. 5.

In this case the connecting means 42 for the transmission of signals between the shield control device and the called sensors 46 by sending the call codeword can be activated only when in addition to and together with the call codeword a code signal (type codeword), characteristic for the type of the function element, is transmitted by the shield control device. This codeword for the type is stored in the memory 61 of the shield control device and is assigned to each incoming command with the address codeword in accordance with the sensor to be triggered. This type codeword is stored also in a memory 57 of the microprocessor 59 of each sensor corresponding to its type. The microprocessor 59 in each sensor triggers the switching element 63 affected in the sense of a connection to the respective sensor 46 only when not only its address code corresponds with the incoming call code but also the type code corresponds with the called type code. This type code cannot be manipulated, consequently it will be ensured that the sensors installed in the longwall shield during the operation are approved and of the required quality.

It is not always necessary to transmit and process two codewords, the address code and type code. The call code in the processor 60 of the shield control device on the one hand and the address code in the microprocessor 59 of the sensors on the other can be rather encrypted with an algorithm that is identical for both, so that the call code is transmitted only in the form encrypted by the type code and it is compared with the address code in the form encrypted by the type code.

The invention claimed is:

1. A shield control device of a longwall shield for carrying out the longwall functions of the longwall shield in the longwall face working in a mine, wherein for the purpose of electrical data transfer the shield control device is connected on the one hand with the external shield control devices, in particular with the shield control devices of the other longwall shields of the longwall face as well as with the central control device and on the other hand via internal connecting means with the function elements of the shield, and wherein the shield control device comprises a microprocessor with memory to store a code signal containing a shield codeword assigned to it and allows data transfer to its function elements via the internal connecting means only when it is triggered by the shield codeword assigned to it, wherein to each function element of the longwall shield a code signal containing an address codeword that is valid only for this function element is assigned, wherein in the internal connecting means between the shield control device and the function elements and spatially close to it a distributor is connected, wherein the distributor comprises a microprocessor with memory as well as switching equipment to switch the internal connecting means, wherein in the memory the address codewords of the assigned function elements are stored, and wherein the switching equipment upon receiving a code signal from the shield control device containing a call codeword can be actuated by the microprocessor in that sense that the connecting means for signal transfer between the shield control device and that function element whose address codeword is identical with the call codeword, can be activated.

2. A shield control device according to claim 1, wherein the connecting means for data transfer between the shield control device and the distributor contain only one cable.

3. A shield control device according to claim 2, wherein the function elements are the operating magnets of the hydraulic valves of the longwall shield and the data transfer is used to transmit operational commands to the operating magnets.

4. A shield control device according to claim 3, wherein the hydraulic valves are combined in a valve block, wherein the distributor is allocated spatially close to the valve block, wherein the distributor is connected with the shield control device via a command cable with at least two wires to transmit operational commands as well as via a voltage line, wherein the distributor comprises the microprocessor with memory as well as the switching equipment with switching elements that can be controlled by it, wherein each operating magnet is connected with the distributor via a voltage line each, wherein the switching elements control the connection of the voltage line to the internal cable connection of each operating magnet, wherein in the memory the address codes for the connected operating magnets are stored, and wherein the switching equipment can be so controlled by an operating command incoming together with a call codeword that via one of the switching elements the current supply of those operating magnets whose address code corresponds with the called call code can be established via the internal cable connection.

5. A shield control device according to claim 4, wherein the hydraulic valves are combined in a valve block, wherein the current connections of the hydraulic valves are next to one another in a specified geometric arrangement as connector connections, wherein the distributor has a batten-shaped construction and has connector connections that geometrically correspond with the connector connections of the operating magnets, and wherein by means of connector connections the distributor is mechanically and electrically joined with the operating magnets without intermediate external cable connections, while the internal cable connections are situated solely within the distributor.

6. A shield control device according to claim 3, wherein the measuring signals in their actual form can be retrieved by connecting the sensor with its distributor.

7. A shield control device according to claim 1, wherein the connecting means for data transfer between the distributor and the function elements contain one lead to each function element.

8. A shield control device according to claim 7, wherein the function elements are the operating magnets of the hydraulic valves of the longwall shield and the data transfer is used to transmit operational commands to the operating magnets.

9. A shield control device according to claim 8, wherein the hydraulic valves are combined in a valve block, wherein the distributor is allocated spatially close to the valve block, wherein the distributor is connected with the shield control device via a command cable with at least two wires to transmit operational commands as well as via a voltage line, wherein the distributor comprises the microprocessor with memory as well as the switching equipment with switching elements that can be controlled by it, wherein each operating magnet is connected with the distributor via a voltage line each, wherein the switching elements control the connection of the voltage line to the internal cable connection of each operating magnet, wherein in the memory the address codes for the connected operating magnets are stored, and wherein the switching equipment can be so controlled by an operating command incoming together with a call codeword that via one of the switching elements the current supply of those operating magnets whose address code corresponds with the called call code can be established via the internal cable connection.

10. A shield control device according to claim 9, wherein the hydraulic valves are combined in a valve block, wherein the current connections of the hydraulic valves are next to one another in a specified geometric arrangement as connector connections, wherein the distributor has a batten-shaped construction and has connector connections that geometrically correspond with the connector connections of the operating magnets, and wherein by means of connector connections the distributor is mechanically and electrically joined with the operating magnets without intermediate external cable connections, while the internal cable connections are situated solely within the distributor.

11. A shield control device according to claim 1, wherein the distributor is in or in the vicinity of each function element, wherein the connecting means for data transfer between the shield control device and the first of the function elements contain only one cable, and wherein the connection of the function elements with one another is carried out by a common busbar and can be controlled by the switching equipment in each function element.

12. A shield control device according to claim 11, wherein the function elements are sensors.

13. A shield control device according to claim 11, wherein the sensors have memories, in which the measuring signals are stored and can be retrieved by connecting the memory with the distributor.

14. A shield control device according to claim 1, wherein the connecting means for signal transfer between the shield control device and the function element can be only activated when from the shield control device in addition to and together with the call codeword a code signal (type codeword), characteristic for the type of the function element and stored in the memory of the microprocessor of each function element according to its type, can be transmitted.

15. A shield control device according to claim 14, wherein according to a specified encoding rule the type codeword to encrypt the call codeword and the address codeword is used in such a manner that for their comparison in the microprocessor the call codeword and the address codeword are present in the form encrypted by the type code.

* * * * *